US005153654A

United States Patent [19]

Yuminamochi et al.

[11] Patent Number: 5,153,654

[45] Date of Patent: Oct. 6, 1992

[54] IMAGE FORMING APPARATUS HAVING TRANSFER MEMBER FOR CARRYING TRANSFER MATERIAL

[75] Inventors: Takayasu Yuminamochi; Koichi Tanigawa, both of Tokyo; Akihiko Takeuchi, Yokohama; Hiroshi Sasame, Yokohama; Yasumasa Ohtsuka, Yokohama; Hiroto Hasegawa, Kawasaki; Hideyuki Yano, Yokohama; Hideo Nanataki, Tokyo, all of Japan

[73] Assignee: Canon Kabushiki Kaisha, Tokyo, Japan

[21] Appl. No.: 740,405

[22] Filed: Aug. 5, 1991

[30] Foreign Application Priority Data

Aug. 3, 1990 [JP] Japan ..... 2-206416

[51] Int. Cl.[5] ..... G03G 15/14

[52] U.S. Cl. ..... 355/277; 355/271

[58] Field of Search ..... 355/271, 277, 276, 273, 355/275, 281

[56] References Cited

U.S. PATENT DOCUMENTS

| | | | |
|---|---|---|---|
| 3,788,203 | 1/1974 | Rhodes | 355/272 X |
| 4,309,803 | 1/1982 | Blaszak | 355/271 X |
| 4,401,383 | 8/1983 | Suzuki et al. | 355/273 X |
| 4,482,240 | 11/1984 | Kuge et al. | 355/274 |
| 4,958,194 | 9/1990 | Kaieda et al. | 355/277 |
| 5,038,178 | 8/1991 | Hosoya et al. | 355/277 |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An image forming apparatus includes a movable image bearing member; an image forming device for forming an image on the image bearing member; and a transfer device for transferring the image from the image bearing member onto a transfer material, the transfer device including a movable transfer member contacted to the image bearing member and for conveying the transfer material by the contact portion. The transfer member is disposed in such a direction that a surface friction in the direction of the movement of the transfer member relative to the image bearing member is large.

11 Claims, 5 Drawing Sheets

IMAGE FORMING APPARATUS HAVING TRANSFER MEMBER FOR CARRYING TRANSFER MATERIAL

FIELD OF THE INVENTION AND RELATED ART

The present invention relates to an image forming apparatus having a transfer member for carrying a transfer material, more particularly to an image forming apparatus having a transfer device which comprises a movable transfer member carrying a transfer material through a transfer position where the transfer material contacts to a moving image bearing member to transfer the image from the image bearing member onto the transfer material.

In such an image forming apparatus, the image bearing member, having a movable surface, is in the form of a rotatable drum, a rotatable belt, a traveling web or the like, including an electrophotographic photosensitive member, an electrostatic recording dielectric member, a magnetic recording member, or the like, in an electrophotographic copying machine, a printer, a facsimile machine or another image forming apparatus, for example.

The transfer member rotationally driven in the same peripheral movement direction of the image bearing member in contact with the surface of the image bearing member is in the form of a roller, belt or the like, supplied or not supplied with a transfer bias.

On the image bearing member, a transferable image such as toner image is produced through a proper image formation process such as an electrophotographic process, an electrostatic recording process, a magnetic recording process or the like.

In the image forming apparatus, in order to transfer the toner image formed on the image bearing member in the form of a photosensitive drum (drum), for example, a transfer material is passed through a nip (transfer position) formed between the drum and a rotatable transfer roller (transfer member) press-contacted thereto. To the transfer position, the transfer material is supplied through a pair of registration rollers, a guiding plate, or the like. In timed relation with the toner image on the drum, the registration rollers are driven so that when the leading edge of the image formation area on the drum reaches the transfer position, the leading edge of the transfer material reaches the transfer position. When the transfer material exists in the transfer position, the transfer roller is supplied with a transfer voltage from a voltage source, the transfer voltage having a polarity opposite to that of the toner, by which the toner image is transferred from the drum onto the transfer material.

The contact type transfer device is advantageous over the conventionally widely used corona discharger type transfer device, in that a high voltage source is not required, and therefore, the cost is low, in that it- does, not use a wire, and therefore, image deterioration attributable to the contamination thereof can be avoided, and in that the production of ozone or nitrogen oxide or the like is very small, and therefore, deterioration due to products deposited on the image bearing member can be practically avoided, for example.

It has been found that the conventional contact type transfer device involves the following problem. The outer diameter of the transfer roller is adjusted by polishing the surface of the rubber material. At this time, the surface of the rubber material becomes fuzzy. Because of this, the contact area between the transfer roller and the transfer material is small, but with passage of time, the surface is polished with the result of an increased contact area between the transfer roller and the transfer material.

By the increase in the contact area between the transfer roller and the transfer material in the transfer position with the use of the device, the friction force increases, with the result that a larger transfer material conveying force is provided so that the conveying speed in the transfer position for the transfer material is increased.

If it is increased, the speed of the transfer material abruptly changes when the trailing edge of the transfer material is released from the nip of the registration rollers. If this occurs, the image is blurred; the image is elongated in the transfer material conveying direction; and the sheet is inclined by the stretching with the registration rollers with the result of degradation of the printing accuracy.

This problem is common in the case of rotating belt as the transfer member.

SUMMARY OF THE INVENTION

Accordingly, it is a principal object of the present invention to provide an image forming apparatus capable of forming good images without blurness or image elongation.

It is another object of the present invention to provide an image forming apparatus wherein the variation in the transfer material conveying force is minimized during long term use.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
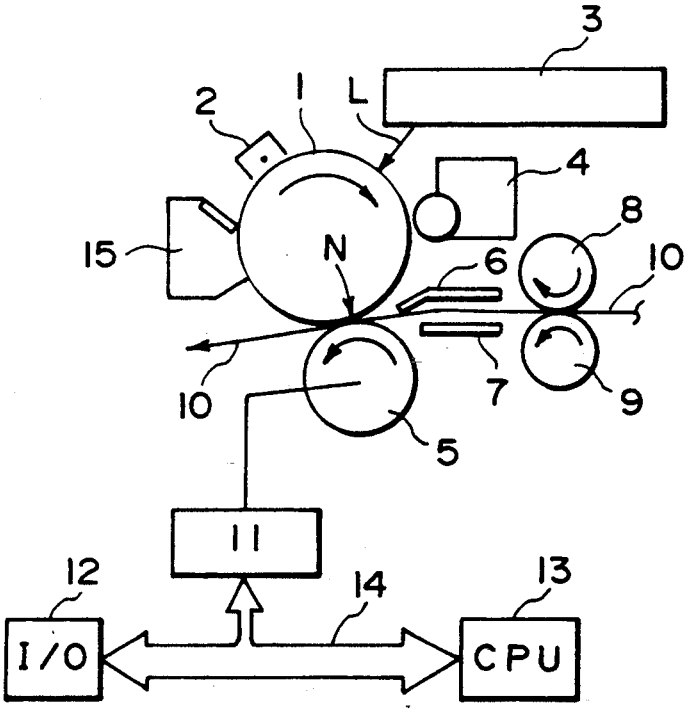
FIG. 2 is a sectional view of an exemplary image forming apparatus according to an embodiment of the present invention.

Referring to FIG. 2, there is shown an exemplary image forming apparatus using a contact type transfer device. In this embodiment, the image forming apparatus is an image transfer type laser beam printer using an electrophotographic process.

It comprises an image bearing member in the form of a photosensitive drum (drum) 1 rotatable at a predetermined peripheral speed (process speed) in the clockwise direction. The drum 1 has an outer diameter of 30 mm and includes an OPC (organic photoconductor) layer. The apparatus further comprises a primary charger (corona discharger) 2 for uniformly charging the peripheral surface of the drum 1 to a negative polarity in this embodiment.

The charged drum surface is exposed to a laser beam (image information lighting beam) L which is produced from a laser scanner 3 and is modulated in accordance with time series electric digital picture element signals representing the image to be recorded. By doing so, the potential of the drum is attenuated at the position exposed to the laser beam, so that an electrostatic latent image of the desired image is formed.

Subsequently, the latent image formed surface of the drum is supplied with toner negatively charged (the same polarity as the latent image) by the developing device 4, so that the latent image is developed through a reverse-development process.

On the other hand, a transfer material (recording material) such as a sheet of plain paper or the like is supplied from an unshown sheet feeding station, and is supplied by a pair of registration rollers 8 and 9 through guiding plates 6 and 7 to a transfer position N constituted by a nip formed between the drum 1 and the transfer member in the form of a rotatable transfer roller 5.

At the instant when the leading edge of the transfer material 10 from the sheet feeding station reaches the nip between the rollers 8 and 9, the registration rollers 8 and 9 are at rest to simply receive the leading edge of the transfer material 10, so that oblique feeding of the transfer material is prevented, and that the registration position is regulated.

In timed relation with the image on the rotating drum 1, the rotatable motion of the registration rollers 8 and 9 is started, by which the leading edge of the transfer material 10 reaches the transfer position N when the leading edge of the image formation region on the drum 1 reaches the transfer position N, along the guiding plates 6 and 7.

When the transfer material 10 exists at the transfer position, that is, the transfer nip formed between the drum 1 and the transfer roller 5, the transfer roller 5 is supplied with an image transfer bias of the positive polarity (the polarity opposite from the charge polarity of the toner) from a voltage source 11 controlled by a control system comprising CPU 13, I/O 12, bus line 14 or the like. By the electric field provide by the applied bias and the urging force to the transfer material 10 to the drum 1 surface by the transfer roller 5, the toner image is sequentially transferred from the drum 1 to the surface of the transfer material 10 supplied to the transfer position L.

The transfer material 10 having passed through the transfer nip N is separated from the drum surface 1, and is conveyed to an unshown image fixing device where the transferred toner image is fixed on the transfer material 10.

The surface of the drum 1 after the separation of the transfer material therefrom, is cleaned by a cleaning device 15, so that residual material such as residual toner or the like is removed so as to be prepared for the next image forming operation.

Figure 1:
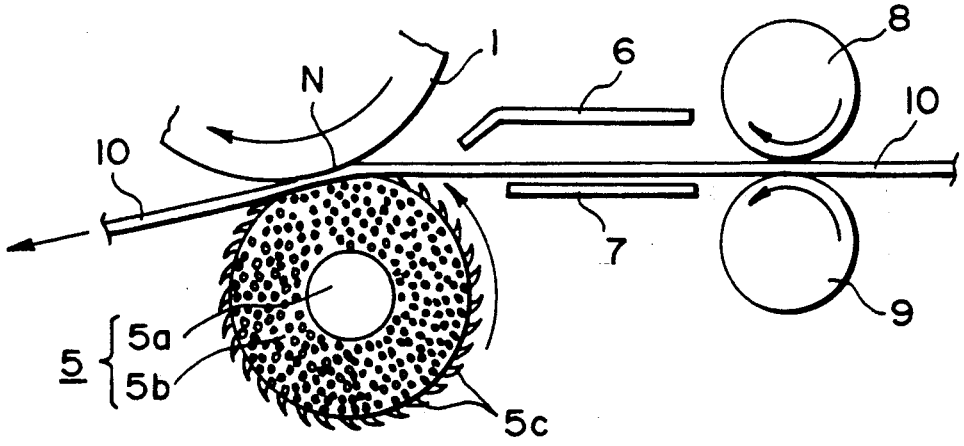
FIG. 1 is a sectional view of a transfer roller according to a first embodiment of the present invention.

FIG. 1 shows an enlarged view of a major part adjacent the transfer device of a laser beam printer shown in FIG. 2.

The transfer roller (rotatable transfer member) 5 in this embodiment comprises a core metal **5*a* having a diameter of 8 mm and a concentric rubber roller portion 5*b*** so as to provide an outer diameter of 21 mm. It is formed through metal molding or the like.

The rubber roller portion **5*b* is of foamed (sponge) EPDM (tercopolymer of ethylene-propylenediene). Zinc oxide, carbon or the like is mixed as electrically conductive material. The resistance of the nip N formed between the image bearing member and the transfer roller 5 is $5\times10^8$ ohm. The cell diameter of the foamed EPDM is 0.1–0.4 mm approximately. The rubber hardness of the rubber roller portion 5*b*** is 30 degrees (Asker C).

In the printer of this embodiment, the transfer material conveying speed at the transfer position L formed between the drum 1 and the transfer roller 5 is 0.5% higher than the drum peripheral speed by properly driving the transfer roller 5 by an unshown driving source. In addition, the rotational speed of the image bearing member is reduced by 0.5% of the regular speed, so that the magnification in the sub-scan direction of the image is zero. The transfer material conveying speed by the registration rollers 8 and 9 is made 0.5% higher than the transfer material conveying speed at the transfer position N.

The relation between the rotations of the drum 1 and the transfer roller 5 is preferably such that the transfer material 10 is conveyed at a speed higher than the drum 1 speed by 0.5–3% at the transfer position by selecting the outer diameter of the transfer roller 5 and the rotational speed thereof in order to prevent local transfer void for character images which can particularly occurs in the case of the transfer roller. The reason why the transfer material conveying speed by the registration rollers 8 and 9 is higher than the transfer material conveying speed at the transfer position N by 0.5% is that the transfer material is slightly slacked between the transfer position N and the registration roller position so as to prevent the shock which is otherwise caused when the trailing edge of the transfer material is released from the nip between the registration rollers 8 and 9.

The transfer roller 5 in accordance with the present invention is in rolling contact with the drum 1 in the direction providing a larger surface friction with respect to the peripheral surface of the transfer roller.

A description will be provided as to the direction of the abrasion during transfer material manufacturing as an example of determining the larger frictional force direction of the transfer roller 5.

Figure 3A:
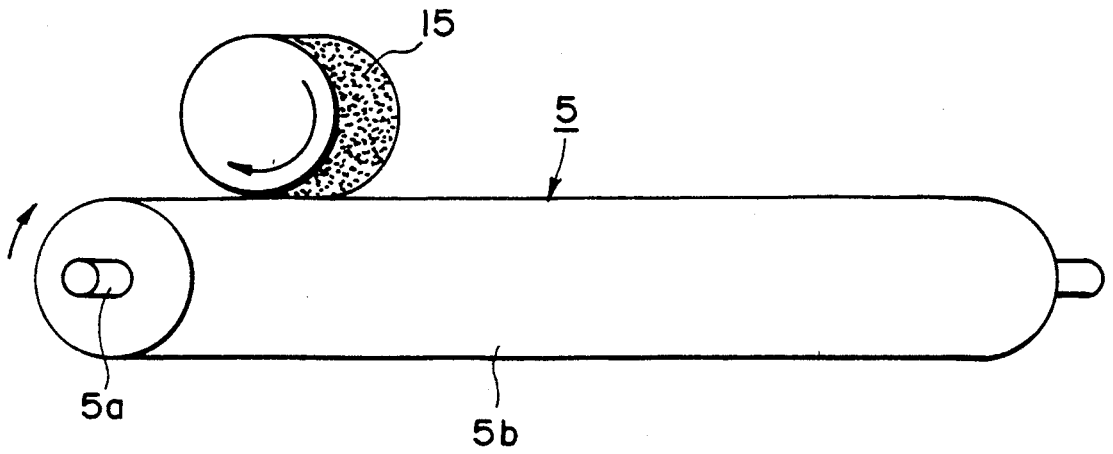
FIGS. 3A and 3B illustrate abrasion of the transfer roller.

FIG. 3A shows the abrasion of the transfer roller 5. The transfer roller 5 is supported on unshown bearings and is rotated in the clockwise direction at the rotational speed of 200 rpm, approximately. A grindstone 15 is rotated in contact with the surface of the transfer roller 5. It is rotated in the direction of the arrow (clockwise direction) at the rotational speed of 2000 rpm, approximately. It is moved from one longitudinal end to the other longitudinal end of the roller 5, by which the outer surface of the roller 5 is abraded.

Since the grind stone 15 rotates at a sufficiently high speed as compared with the transfer roller 5, and therefore, the grinding or abrading direction may be considered in view of the rotational direction of the grind stone only, for the sake of simplicity.

Figure 3B:
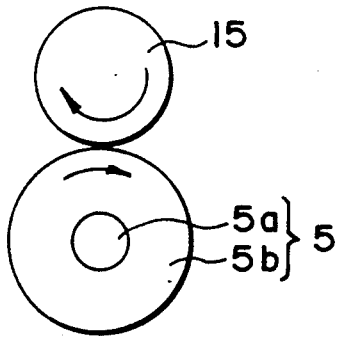

Since the grind stone 15 rotates in the clockwise direction in FIG. 3A FIG. 3B, and the surface of the abraded transfer roller 5 acquires grain 5*c* (FIG. 3C), so that it comes to have directivity in the circumferential direction with respect to surface friction.

Figure 3C:
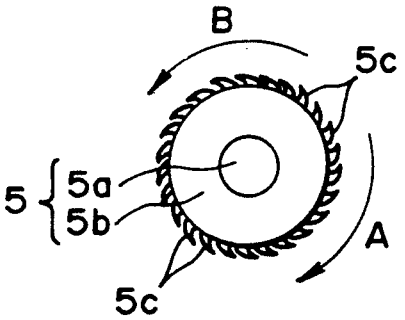
FIG. 3C shows codirectional fuzz and counterdirectional fuzz.

More particularly, investigating the surface friction in the peripheral direction of the transfer roller 5 after being abraded, a sheet or the like contacts to the surface of the roller and is moved. It has been found that the frictional force is large when the sheet is moved in the direction A (FIG. 3C), and the friction force is small when the sheet is moved in the opposite direction B. The direction A is counterdirectional with respect to the grain of the surface of the transfer roller 5, and the direction B is codirectional with the grain. This is because the roller surface has the directivity, as shown in FIG. 3C.

Figure 4:
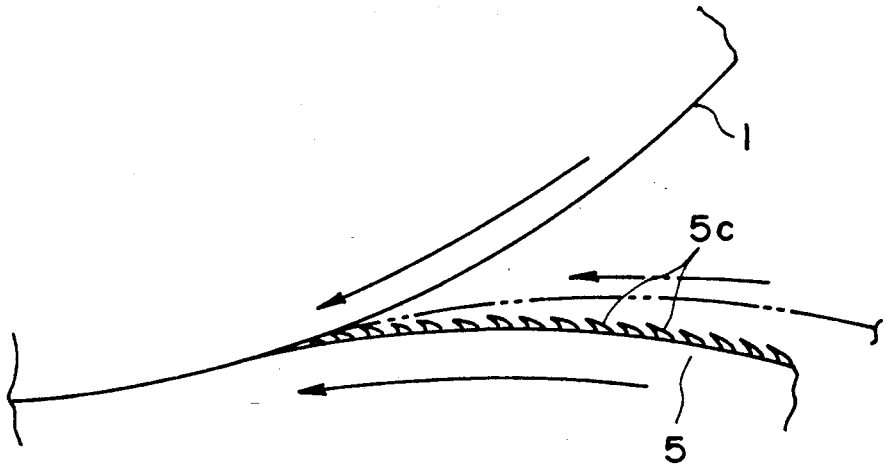
FIG. 4 shows the surface of the transfer roller adjacent the transfer position where there is a counterdirectional arrangement.
Figure 5:
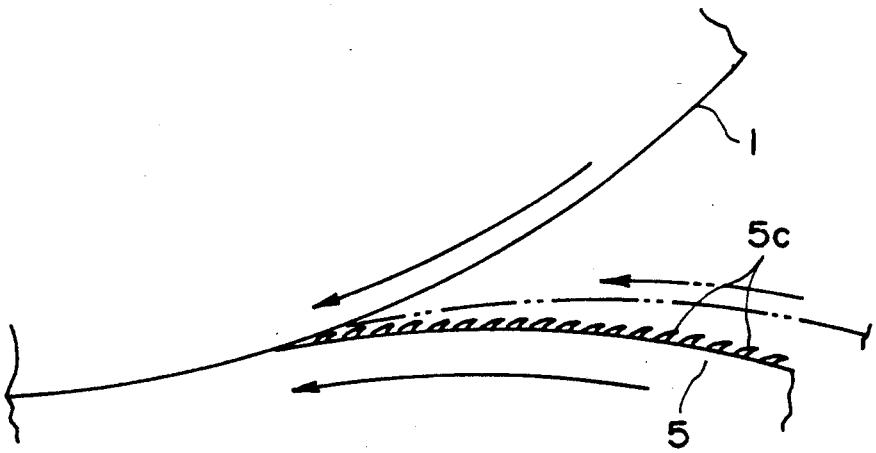
FIG. 5 is similar to FIG. 4, but it shows the codirectional arrangement.

As shown in FIG. 4, the transfer roller 5 in this embodiment is so disposed that the transfer roller 5 rotates in contact with the photosensitive drum 1 in such a direction that the surface friction force is larger. This arrangement is called the "counterdirectional arrangement". In FIG. 5, the transfer roller 5 is disposed in contact with the drum in such a direction that the friction force is smaller. This arrangement is called the "codirectional arrangement".

Figure 6:
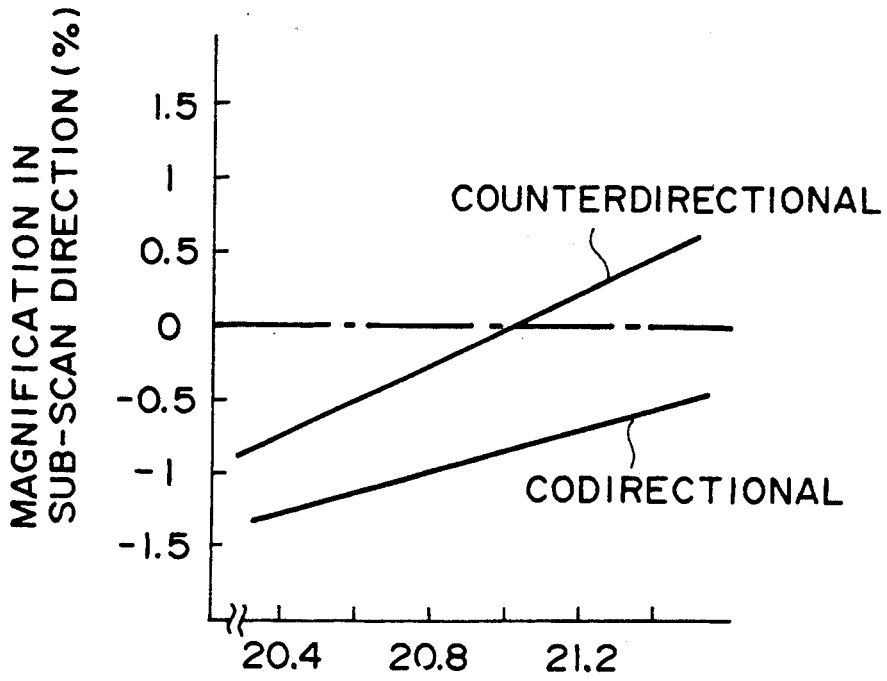
FIG. 6 is a graph of the transfer material conveying force difference at the transfer position in the counterdirectional arrangement and the codirectional arrangement.

FIG. 6 is a graph showing the difference in the conveying force for the transfer material 10 by the transfer position N in the cases of the counterdirectional arrangement (FIG. 4) and codirectional arrangement (FIG. 5).

Figure 7:
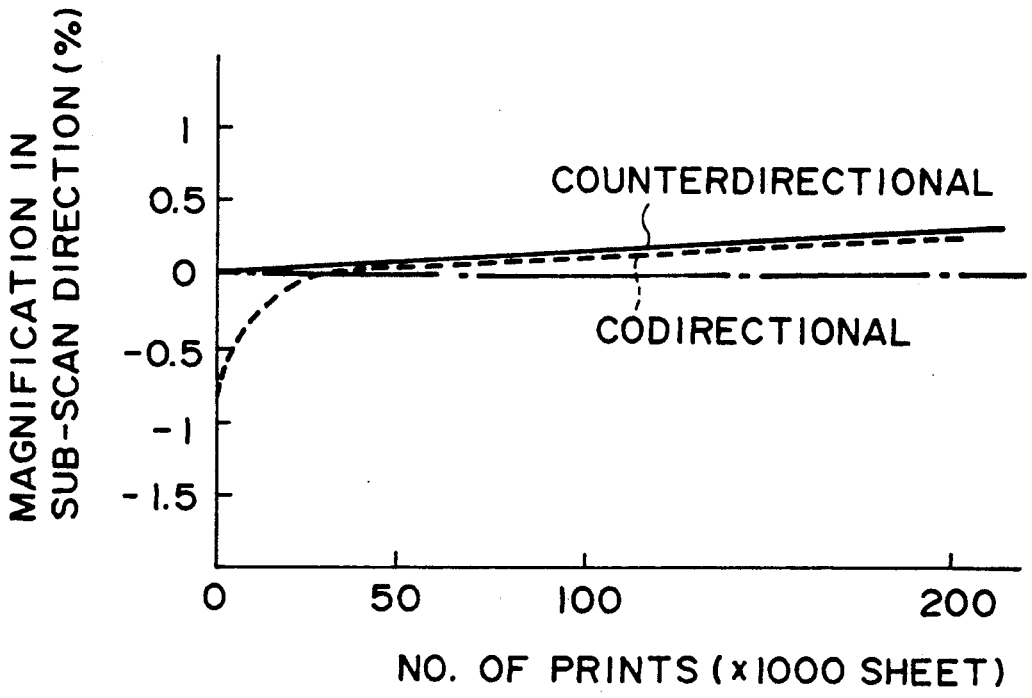
FIG. 7 shows a relation between the number of prints and the transfer material conveying speed at the transfer position which is represented by the magnification in the sub-scan direction.

The abscissa represents diameters of the transfer roller 5, and the ordinate represents the conveying speed of the transfer material relative to the drum peripheral speed, as a magnification in the sub-scanning direction. As will be understood from the graph, the transfer material conveying speed by the transfer position N is 0.5–1% higher in the counterdirectional arrangement than in the codirectional arrangement. FIG. 7 is a graph showing a relation between the number of prints and the transfer material conveying speed by the transfer nip, as the sub-scan direction magnification. The solid line represents the sub-scan direction magnification in the case of the counterdirectional arrangement, and the broken line represents that in the case of the codirectional arrangement.

In the case of the codirectional arrangement, the transfer material conveying force changes remarkably at the initial stage of the use, but in the case of the counterdirectional arrangement, the initial conveying force change is small, and the change is not significant throughout the 200,000 sheet printings.

Therefore, it is understood that the transfer material conveying force change attributable to the wearing of the abrasion grain on the surface of the transfer roller is smaller in the counterdirectional arrangement than in the codirectional arrangement. Accordingly, the trailing edge blurness of the image after long term use or the degradation of the printing accuracy after the long term use, can be prevented.

In other words, if the codirectional arrangement is used and if it is designed such that the image blurness is prevented, and the printing accuracy is satisfactory at the initial stage of the use. The image quality is deteriorated in the long term use. However, in the case of the counterdirectional arrangement of the transfer roller, the deterioration of the image quality described above can be prevented.

This is because the peripheral speed of the transfer roller is higher than the peripheral speed of the drum, and therefore, the counterdirectional abrasion grain 5*c* of the transfer roller functions effectively for the transfer roller conveyance. Therefore, the advantage is smaller in the case where the transfer roller peripheral speed is equal to or smaller than the drum peripheral speed or in the case where the transfer roller rotates following the drum rotation.

A description will be now provided as to the solid silicone rubber roller in place of the foamed EPDM roller of the foregoing embodiment.

Also in the case that the transfer roller 5 is constituted by a solid silicone rubber material, the outer diameter is adjusted by abrasion.

Figure 8A:
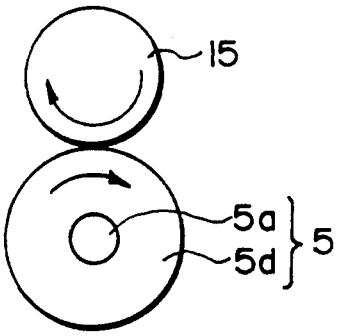
FIG. 8A illustrates abrasion of the silicone rubber roller.
Figure 8B:
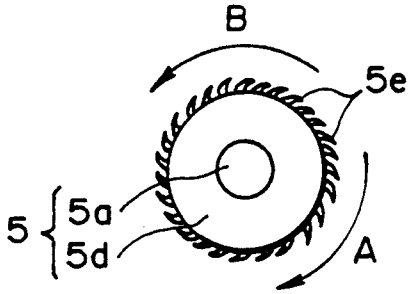
FIG. 8B illustrates the codirectional abrasion and the counterdirectional abrasion, after the abrasion.

FIG. 8A shows the relation between the silicone rubber roller 5 and grind stone 15 during the abrasion operation. The method of abrasion is the same as in the case of FIGS. 3A and 3B. Designated by a reference 5*d* is a silicone rubber roller.

The silicone rubber roller 5*d* has a JIS-A hardness of 20 degrees, and the resistance thereof is adjusted by conductive zinc oxide or carbon. The resistance between the core metal 5*a* and the nip formed between the drum 1 and the transfer roller 5 is approximately $5\times10^8$ ohm.

The grind stone 15 is rotated in the clockwise direction indicated by an arrow to abrade the transfer roller 5. Then, the abrasion grain 5*e* in the case of the solid silicone rubber roller 5*d* is the opposite from that in the case of the foamed EPDM roller 5*d*. The surface friction force in the circumferential direction of the abraded silicone rubber roller when a material is slid on the surface of the roller, is small in the A direction, and is large in the B direction.

Also in the case of the solid silicone rubber transfer roller, the abrasion grain 5*e* is scraped with use, in a similar manner to the case of the foamed EPDM transfer roller, and the contact area between the transfer roller and the transfer material increases. Therefore, the conveying speed for the transfer material increases. The amount of change is smaller when the transfer roller is arranged counterdirectionally than when it is arranged codirectionally.

In this embodiment, the transfer roller is used in the counterdirectional arrangement providing the large frictional resistance although the arrangement is opposite from the standpoint of the rotational direction of the grindstone during the abrading operation. By doing so, image blurness is prevented, and the printing accuracy is maintained for long time use from the initial stage of the use.

Figure 9A:
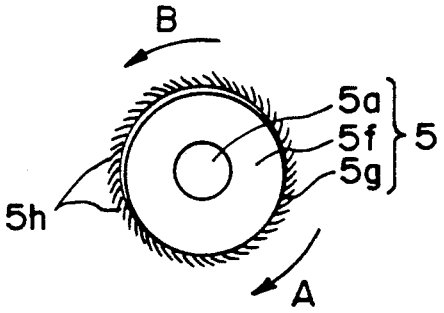
FIG. 9A illustrates a fiber planted roller.
Figure 9B:
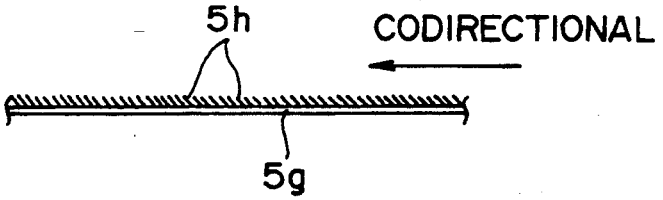
FIG. 9B shows the direction of the fibers.

Referring to FIG. 9A, another embodiment of the transfer member will be described. In this embodiment, the transfer member is in the form of a transfer roller 5 comprising a core metal 5*a* and a roller portion 5*f* made of sponge rubber material having an Asker C hardness of 20 degrees. The outer peripheral surface of the roller portion 5*f* is coated with fibrous cloth 5*g* in which conductive fibers 5*h* are planted.

The outer fibrous cloth 5g is effective to increase the charge supplying efficiency to the transfer material. By increasing the number of peak shapes on the outer peripheral surface of the transfer roller by the planting or the like, the charge supplying efficiency to the transfer material due to discharge is improved, and therefore, the transfer performance is enhanced. The fibrous cloth 5g has a directional tendency in a predetermined direction in the fibers 5h during manufacturing or storing (when they are stacked in a storage or the like). Therefore, the transfer roller 5 coated with the fibrous cloth 5g has a directivity in the frictional force in the circumferential direction due to the directional tendency of the fibers described above.

In FIG. 9A, the friction is compared between the A direction and the B direction when the surface of the roller 5 is rubbed with a sheet or the like, the friction is stronger in the A direction.

The fibers are slightly removed from the cloth at the initial stage of the use although the amount thereof is not significant to the image quality. However, the contact area thereof with the transfer material increases with the result that the transfer material conveying force increases.

In this embodiment, too, the transfer roller 5 is disposed in the counterdirectional arrangement, by which the change of the transfer material conveying speed by the transfer nip N during long term use is decreased, so that the image blurness prevention and the printing accuracy are maintained for the long term.

In the foregoing the charging member has been in the form of a transfer roller, but the present invention is applicable to the rotatable belt type charging member with the same advantageous effect.

As described in the foregoing, according to the present invention, the change in the conveying speed for the transfer material by the transfer station due to the use of the contact type transfer device, can be reduced, and therefore, the deterioration of the image blurness preventing effect and the printing accuracy can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member;

transfer means for transferring the image from said image bearing member onto a transfer material, said transfer means including a movable transfer member contacting said image bearing member and for conveying the transfer material by the contact portion thereof;

wherein the coefficient of friction between said image bearing member and said transfer member during conveyance of the transfer material in the movement direction of the transfer material is larger than the coefficient of friction between the said image bearing member and said transfer member in a direction opposite from the movement direction.

2. An apparatus according to claim 1, wherein said transfer member is a rotatable member.

3. An apparatus according to claims 1 or 2, wherein the conveying speed of the transfer material at the contact portion is larger than the movement of said image bearing member.

4. An apparatus according to claim 3, wherein the conveying speed is larger than the movement speed by 0.5–3%.

5. An apparatus according to claim 1, wherein said transfer means including voltage application means for applying a voltage to said transfer member.

6. An apparatus according to claim 1, wherein said transfer member has a surface having been abraded at the contact portion.

7. An apparatus according to claim 6, wherein said transfer member has a surface EPDM sponge layer.

8. An apparatus according to claim 6, wherein said transfer member has a solid silicone rubber layer at its surface.

9. An apparatus according to claim 1, further comprising feeding means for feeding the transfer material to the contact portion, and wherein the transfer material feeding speed generated by said feeding means is larger than the movement speed of a surface of said image bearing member.

10. An apparatus according to claim 9, wherein the conveying speed is larger than the movement speed by 0.5–3%.

11. An apparatus according to claim 1, wherein said image bearing member is a photosensitive member.

* * * * *

UNITED STATES PATENT AND TRADEMARK OFFICE

CERTIFICATE OF CORRECTION

PATENT NO. : 5,153,654

DATED : October 6, 1992

INVENTOR(S) : TAKAYASU YUMINAMOCHI, ET AL.

It is certified that error appears in the above-identified patent and that said Letters Patent is hereby corrected as shown below:

COLUMN 1

Line 58, "it- does," should read --it does--.

COLUMN 3

Line 60, "provide" should read --provided--.

COLUMN 4

Line 43, "occurs" should read --occur--.

COLUMN 5

Line 9, "FIG. 3A FIG. 3B, and" should read --FIG. 3A and FIG. 3B,--.

COLUMN 8

Line 16, "member in" should read --member during conveyance of the transfer material in--.

Signed and Sealed this

Twelfth Day of October, 1993

*Attest:*

*Attesting Officer*

Bruce Lehman

BRUCE LEHMAN

*Commissioner of Patents and Trademarks*